United States Patent [19]

Tauber et al.

[11] 4,449,952

[45] May 22, 1984

[54] METHOD OF OPERATING A COLD CATHODE-COLD RESERVOIR THYRATRON

[75] Inventors: Arthur Tauber, Long Branch; Robert D. Finnegan, West Long Branch; Frederick Rothwarf, Toms River, all of N.J.

[73] Assignee: The United States of America as represented by the Secretary of the Army, Washington, D.C.

[21] Appl. No.: 83,071

[22] Filed: Oct. 9, 1979

[51] Int. Cl.[3] ..... H01J 7/18

[52] U.S. Cl. ..... 445/55

[58] Field of Search ..... 316/25; 313/174

[56] References Cited

U.S. PATENT DOCUMENTS

| | | | |
|---|---|---|---|
| 2,890,319 | 6/1959 | Watrous, Jr. | 313/174 X |
| 3,324,331 | 6/1967 | Reinhardt | 313/174 X |
| 3,408,130 | 10/1968 | Fransen et al. | 316/25 |
| 3,669,567 | 6/1972 | Porta et al. | 316/25 |

OTHER PUBLICATIONS

"Equilibrium Studies on the Systems $ZrCr_2$-$H_2$, $ZrV_2$-$H_2$, and $ZrMO_2$-$H_2$ between 0 degree and 900 degrees C.," by Pebler and Gulbransen, Transactions of the Metallurgical Society of AIME, vol. 239, Oct. 1967 at pp. 1593 to 1600.

"Hydrogen Absorption and Desorption Properties of $AB_2$ Laves-Phase Pseudobinary Compounds," by Shaltiel, Jacob and Davidov, Journal of the Less Common Metals, 53 (1977) at pp. 117 to 131.

*Primary Examiner*—Joseph H. McGlynn

*Attorney, Agent, or Firm*—Anthony T. Lane; Jeremiah G. Murray; Roy E. Gordon

[57] ABSTRACT

A method is disclosed of operating a cold-cathode-cold-reservoir thyratron for laser/radar and other systems employing high voltage and current pulses using ZrVFe as the hydrogen thyratron material. According to the method, a hydride of ZrVFe is first formed and the hydrided material then placed in the cathode structure of the thyratron. The tube is then pumped down to its operating pressure of approximately $10^{-3}$ atmospheres, the hydrided material then acting as a ballast to maintain that partial pressure of hydrogen at room temperature.

4 Claims, No Drawings

METHOD OF OPERATING A COLD CATHODE-COLD RESERVOIR THYRATRON

The invention described herein may be manufactured, used, and licensed by or for the Government for governmental purposes without the payment to us of any royalty thereon.

This invention relates in general to a method of providing a cold cathode-cold reservoir thyratron with an operating pressure plateau of approximately $10^{-3}$ atmosphere in the thyratron, and in particular to such a method using ZrVFe as the thyratron reservoir material.

BACKGROUND OF THE INVENTION

Current high power, hydrogen thyratrons employ a titanium hydride reservoir that requires heating to approximately 700 degrees C. This results in an excessive consumption of power for the new tubes being designed for specialized purposes, as for example, airborne operations.

Cold-cathode-cold-reservoir thyratrons are required for laser/radar and other systems employing high voltage and current pulses. The great advantage of cold-cathode-cold-reservoir devices is the savings in weight, cost and power.

One of the difficulties with operating such cold-cathode-cold-reservoir thyratrons has been finding suitable hydrogen absorbing/desorbing materials. That is, suitable materials must exhibit a storage capacity for hydrogen and a reasonable desorption rate to be practical.

SUMMARY OF THE INVENTION

The general object of this invention is to provide a method of providing a cold-cathode-cold-reservoir thyratron for laser/radar and other systems employing high voltage and current pulses with an operating pressure plateau of approximately $10^{-3}$ atmosphere in the thyratron. A more particular object of the invention is to provide such a method using a suitable hydrogen thyratron reservoir material.

It has now been found that the aforementioned objects can be attained by using as the hydrogen thyratron reservoir material, the hydride of a compound that simultaneously exhibits a large capacity for storing hydrogen, a desorption pressure plateau between $10^{-3}$ and $10^{-4}$ atmospheres of hydrogen and rapid desorption and recovery rate. Particularly desirable is the use of the hydride of the intermetallic compound ZrVFe as the hydrogen thyratron reservoir material.

More particularly, ZrVFe is first hydrided, the resulting hydride placed in the cathode structure of the thyratron, and the tube then pumped down to its operating pressure of approximately $10^{-3}$ atmosphere. There, the hydride acts as a ballast to maintain that partial pressure of hydrogen at room temperature. Since the metal parts of the thyratron tube tend to getter or absorb hydrogen during the tube operation at elevated temperatures, it is essential that the hydrogen reservoir be part of the tube structure so as to replace the absorbed hydrogen and to maintain the suitable operating pressure needed to form the hydrogen plasma essential for the operation of the tube. It has been found in this connection that about 2 moles of atomic hydrogen are available per mole of compound in the tube operating pressure range of $10^{-4}$ to $10^{-3}$ atmospheres.

DESCRIPTION OF THE PREFERRED EMBODIMENT

ZrVFe is prepared by arc melting the appropriate mixture of constituent metals on a water cooled hearth in an argon atmosphere. The resulting billets are then wrapped in tantalum foil, sealed in an evacuated quartz tube, annealed at 1120 degrees C. for 1 week and then quenched in water. The samples are primarily cubic Laves phases with a small amount of the hexagonal polymorph present as determined by x-ray diffractometry.

The compound is then hydrided by successively pressurizing the sample with hydrogen at room temperature to 100 atmospheres and then quenching to 1 atmosphere several times. Complete hydriding of ZrVFe can be more easily accomplished by heating in hydrogen between 200 and 300 degrees C.

The hydrided material is then placed in the cathode structure of the thyratron, and the tube then pumped down to its operating pressure of approximately $10^{-3}$ atmospheres. The material then acts as a ballast to maintain that partial pressure of hydrogen at room temperature.

It should be noted that heretofore; thyratron titaniumhydride reservoirs have been operated at a point on the steep $\alpha$ region of the log Pressure vs Hydrogen concentration isotherm. This has led to an ultimate decline in the operating pressure of the tube with aging or use. In the current invention, the use of a metal hydride in the $(\alpha+\beta)$ plateau region of the log Pressure vs Hydrogen concentration isotherm is taught so as to minimize the difficulty.

The reason that ZrVFe when hydrided performs well as a hydrogen absorbing/desorbing material in a cold-cathode-cold reservoir thyratron is due to the fact that its desorption kinetics are sufficiently rapid for practical tube operation. That is, in the elapsed time between pulses, the reservoir desorbs sufficient hydrogen to restore the required equilibrium pressure.

We wish it to be understood that we do not desire to be limited to the exact details as described for obvious modifications will occur to a person skilled in the art.

What is claimed is:

1. Method of providing a cold cathode-cold reservoir thyratron for laser/radar and other systems with an operating pressure plateau of approximately $10^{-3}$ atmosphere in the thyratron, comprising forming the hydride of a compound that simultaneously exhibits a large capacity for storing hydrogen, a desorption pressure plateau between $10^{-3}$ and $10^{-4}$ atmosphere of hydrogen and rapid desorption and recovery rate, placing the hydrided compound in the cathode structure of the thyratron, and then pumping the tube down to its operating pressure plateau of approximately $10^{-3}$ atmosphere, the hydrided compound acting as a ballast to maintain that partial pressure of hydrogen at room temperature.

2. Method according to claim 1 wherein said compound is an intermetallic compound with suitable hydrogen absorption and desorption characteristics.

3. Method according to claim 2 wherein said intermetallic compound is ZrVFe.

4. Method according to claims 2 or 3 wherein said intermetallic compound is operated in the $\alpha+\beta$ pressure plateau region of its log Pressure vs Hydrogen concentration isotherm.

* * * * *